US010420446B2

(12) United States Patent
Tolchard

(10) Patent No.: US 10,420,446 B2
(45) Date of Patent: Sep. 24, 2019

(54) HANDHELD CORDLESS DUST REMOVAL APPLIANCE

(71) Applicant: Cody C. Tolchard, Edmonton (CA)

(72) Inventor: Cody C. Tolchard, Edmonton (CA)

( * ) Notice: Subject to any disclaimer, the term of this patent is extended or adjusted under 35 U.S.C. 154(b) by 5 days.

(21) Appl. No.: 15/619,944

(22) Filed: Jun. 12, 2017

(65) Prior Publication Data

US 2018/0353029 A1 Dec. 13, 2018

(51) Int. Cl.

| | |
|---|---|
| ***A47L 9/06*** | (2006.01) |
| ***A47L 5/24*** | (2006.01) |
| ***A47L 9/28*** | (2006.01) |

(52) U.S. Cl.

CPC ..... *A47L 9/0693* (2013.01); *A47L 5/24* (2013.01); *A47L 9/0673* (2013.01); *A47L 9/2857* (2013.01); *A47L 9/2884* (2013.01)

(58) Field of Classification Search

CPC ..... A47L 9/0693; A47L 5/24; A47L 9/0673; A47L 9/2847; A47L 9/2857; A47L 9/2884

See application file for complete search history.

(56) References Cited

U.S. PATENT DOCUMENTS

| | | | | |
|---|---|---|---|---|
| 1,433,021 | A | 10/1922 | Michael | |
| 2,214,989 | A | 9/1940 | Brand | |
| 2,747,217 | A | 5/1956 | Stahl | |
| 4,956,892 | A * | 9/1990 | Fawkes | A47L 5/24 15/339 |
| 4,972,541 | A * | 11/1990 | Smith, Jr. | A47L 5/24 15/105 |
| 5,857,239 | A | 1/1999 | Oh et al. | |
| 6,799,350 | B1 * | 10/2004 | Gordon | A47L 5/24 15/1.51 |
| 6,966,099 | B2 | 11/2005 | Muller | |
| 7,571,514 | B2 * | 8/2009 | Shih | A47L 9/0416 15/363 |
| 7,784,137 | B2 | 8/2010 | Knopow | |
| 7,784,149 | B2 | 8/2010 | Schwarz et al. | |
| 8,769,766 | B2 * | 7/2014 | Hilton | A46B 9/02 15/344 |
| 9,022,038 | B2 * | 5/2015 | Shakouri Moghadam | A24F 1/30 131/173 |
| 2014/0366312 | A1 * | 12/2014 | Christensen | A47L 7/0066 15/344 |

* cited by examiner

*Primary Examiner* — Dung Van Nguyen
(74) *Attorney, Agent, or Firm* — Peter A. Hurley; Richard L. Miller

(57) ABSTRACT

A brush that is hand-held, cordless, rechargeable, self-cooling, and vacuum operated, so as to loosen and collect dust and other small particles from a surface. The brush includes a plurality of exterior components and a plurality of interior components. The plurality of interior components are contained within the plurality of exterior components, and therewith, are the hand-held, the cordless, the rechargeable, the self-cooling, and the vacuum operated, so as to loosen and collect the dust and the other small particles from the surface.

23 Claims, 3 Drawing Sheets

HANDHELD CORDLESS DUST REMOVAL APPLIANCE

BACKGROUND OF THE INVENTION

Field of the Invention

The present invention relates to a dust removal appliance, and more particularly, a handheld cordless dust removal appliance.

Description of the Prior Art

Numerous innovations for dusting implements taken singularly or in combination with other related devices have been provided in the prior art that will be described. Even though these innovations may be suitable for the specific individual purposes to which they address, however, they differ from the present invention.

A FIRST EXAMPLE, U.S. Pat. No. 1,433,021, Published/Issued on Oct. 24, 1922, to Michael teaches a device including a casing having an open lower end and a nozzle secured thereover, a plurality of rotatable brushes supported within the nozzle, a vertically disposed shaft mounted in the casing having driving connection with the brushes, a fly wheel carried on the shaft, and a radially disposed bifurcated reciprocal element in the casing having one end slidably received in a portion of the walls thereof. One side of the element has a rack formed thereon. Further included is a pinion engaging the rack and mounted within the casing, a gear mounted in proximity to the pinion, a slop clutch connected to the pinion and engageable with the gear, a second pinion fixedly mounted upon the upper portion of the vertical shaft and meshing with the aforesaid gear, manually operable apparatus arranged upon and exteriorly of the casing engageable with the outer end of the bifurcated element for imparting sliding movement to the same, spring apparatus engaging the casing and a portion of the element for retaining the same in its normal position, a fan fixedly mounted upon the vertical shaft, and a container detachably connected to the casing adjacent an outlet opening therein communicating with the shaft.

A SECOND EXAMPLE, U.S. Pat. No. 2,214,989, Published/Issued on Sep. 17, 1940, to Brand in U.S. class 15 and subclass 158 teaches a feather duster attachment for vacuum cleaners, which includes a flexible conical-shaped member having apparatus at its restricted end of attachment to the tubular handle of a vacuum cleaner and a plurality of detachable annular sections formed on its enlarged end for shortening the same, and a plurality of annularly arranged feathers secured to the flexible member and projecting beyond the latter's enlarged end. The annular sections are detachable one form another to permit the shortening of the enlarged part of the conical-shaped member, whereby the feathers and the enlarged end of the conical-shaped member may be normally maintained in such relative positions with respect to each other that when the feathers break or become worn they still be made to project beyond the enlarged end of the conical-shaped member.

A THIRD EXAMPLE, U.S. Pat. No. 2,747,217, Published/Issued on May 29, 1956, to Stahl in U.S. class 15 and subclass 374 teaches a hollow suction brush for use with a suction cleaner, which includes a tubular shank for attaching the brush to the end of a suction air conduit, and a brush back secured to the inlet end of the shank and having a passage extending therethrough in communication with the tubular shank. The back has concentrically arranged upper and lower flanges surrounding the passage and in spaced planes traversing the passage to provide anchorages for concentric rows of bristles. Further included is and endless row of relatively long and flexible bristles anchored in the upper flange, an endless row of relatively short and stiff bristles anchored to the lower flange, and a flexible tubular shroud member closely spaced inwardly of the row of short bristles. The free ends of the rows of bristles terminate in closely spaced parallel planes with the ends of the shorter bristles terminating above the free ends of the longer bristles, whereby the ends of the shorter bristles may be brought into contact with the surface being cleaned by pressing downwardly on the tool and deflecting the longer bristles. The planes are inclined with respect to planes through the anchored ends of the bristles, whereby the lengths of both rows of bristles gradually varies from the front to the back of the brush, thereby enabling the user to obtain cleaning sections of varying intensity depending on which portions of the rows of bristles are brought into contact with the surface being cleaned.

A FOURTH EXAMPLE, U.S. Pat. No. 5,857,239, Published/Issued on Jan. 12, 1999, to Oh, et al. in U.S. class 15 and subclass 321 teaches a vacuum cleaner including a moisture cleaner device that is attachable and removable. The moisture cleaner device includes a frame providing the circulation track of the moisture cleaner, a working roller and a driven roller mounted sideways in the top and lower part of the frame, a first coupling apparatus for attachment and removal of the lower part of the moisture cleaner to the vacuum suction head section, a second coupling apparatus for attachment and removal of the top part of the moisture cleaner to a connecting pipe, and a moisture cleaner mounted to the surface of the frame. Because the peripheral surface of the working roller is uneven, when the vacuum suction head portion is moved back and forth the working roller and driven roller are rotated, the moisture cleaner thus being operative so that the moisture cleaner contacts the floor as the normal vacuum suction cleaning proceeds.

A FIFTH EXAMPLE, U.S. Pat. No. 6,966,099, Published/Issued on Nov. 22, 2005, to Muller in U.S. class 15 and subclass 393 teaches a duster nozzle for vacuum cleaners, which includes tube carrying a duster at the air flow entrance end. The duster has duster elements that decrease in length, at least partially, along the direction that is transverse to the air flow at the entrance end of the nozzle.

A SIXTH EXAMPLE, U.S. Pat. No. 7,784,137, Published/Issued on Aug. 31, 2010, to Knopow in U.S. class 15 and subclass 22.1 teaches a handheld dust removal devices that selectively utilize vacuum pressure. Preferably, each device includes a small lightweight handle that houses a vacuum assembly having an electric motor and a battery. The device further includes a duster assembly with elongate fiber strands that have elongate voids extending therethrough or thereinto. The vacuum source can be fluidly connected to and draw a vacuum airflow through the duster assembly, for example, through and/or around the fiber strands. In this configuration, the elongate voids of the fiber strands can at least partially direct or influence the travel path of dust, debris, and/or other particulates that are entrained in a vacuum airflow. Some implementations further include an auxiliary vacuum inlet that is adapted and configured for drawing large particles, such as, crumbs, hair, and other things thereinto. The auxiliary vacuum port can be displaced from the duster assembly, e.g., mounted to the handle or elsewhere.

A SEVENTH EXAMPLE, U.S. Pat. No. 7,784,149, Published/Issued on Aug. 31, 2010, to Schwarz, et al. In U.S.

class 15 and subclass 344 teaches hand-held dust removal devices that selectively utilize vacuum pressure. Preferably, each device includes a small lightweight handle that houses a vacuum assembly having an electric motor and a battery. The device further includes a duster assembly for removably holding a dusting cloth or cover, whereby it can be used similarly to a conventional duster. The vacuum source can be fluidly connected to and draw a vacuum airflow through the duster assembly, for example, through and/or around the dusting cloth. In some implementations, this is done by drawing the vacuum airflow toward opposing lateral portions of the duster assembly. Some implementations further include an auxiliary vacuum inlet that is adapted and configured for drawing large particles, such as, crumbs, hair, and other things thereinto. The auxiliary vacuum port can be displaced from the duster assembly, e.g., mounted to the handle or elsewhere, as desired.

It is apparent now that numerous innovations for dusting implements taken singularly or in combination with other related devices have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a handheld cordless dust removal appliance that avoids the disadvantages of the prior art.

ANOTHER OBJECT of the present invention is to provide a handheld cordless dust removal appliance that is simple and inexpensive to manufacture.

STILL ANOTHER OBJECT of the present invention is to provide a handheld cordless dust removal appliance that is simple to use.

BRIEFLY STATED, STILL YET ANOTHER OBJECT of the present invention is to provide a brush that is hand-held, cordless, rechargeable, self-cooling, and vacuum operated, so as to loosen and collect dust and other small particles from a surface. The brush includes a plurality of exterior components and a plurality of interior components. The plurality of interior components are contained within the plurality of exterior components, and therewith, are hand-held, cordless, rechargeable, self-cooling, and vacuum operated, so as to loosen and collect the dust and the other small particles from the surface.

The novel features that are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawings.

BRIEF DESCRIPTION OF THE DRAWINGS

The figures of the drawings are briefly described as follows.

A MARSHALING OF REFERENCE NUMERALS UTILIZED IN THE DRAWINGS

Introductory

Figure 1:
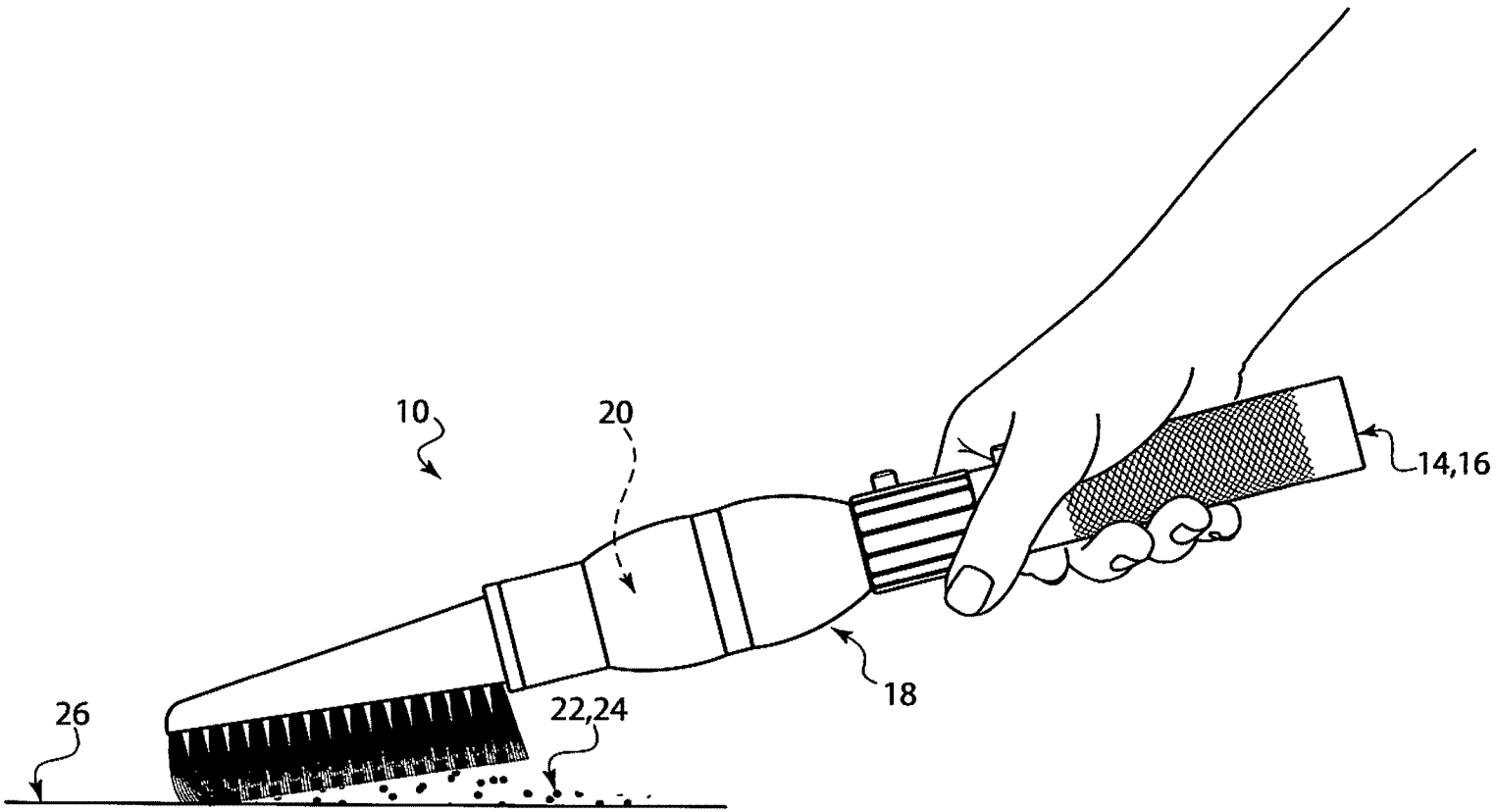
FIG. 1 is a diagrammatic perspective view of the handheld cordless dust removal appliance in use.

10 brush of embodiments of present invention for being hand-held 12, cordless 14, rechargeable 16, self-cooling 18, and vacuum operated 20, so as to loosen and collect dust 22 and other small particles 24 from a surface 26
12 hand-held
14 cordless
16 rechargeable
18 self-cooling
20 vacuum operated
22 dust
24 other small particles
26 surface

Overall Configuration of Brush 10

28 plurality of exterior components
30 plurality of interior components

Specific Configuration of Plurality of Exterior Components 28

32 vacuum intake brush body of plurality of exterior components 28
34 nylon fiber strands of plurality of exterior components 28
36 working end of brush 10
38 threaded brush body connector of plurality of exterior components 28
40 anterior coupler of plurality of exterior components 28
40*a* anterior portion of anterior coupler 40 of plurality of exterior components 28
40*b* remaining posterior portion of anterior coupler 40 of plurality of exterior components 28
42 front integral unit of plurality of exterior components 28
44 filter housing of plurality of exterior components 28
46 posterior coupler of plurality of exterior components 28
48 electric fan housing of plurality of exterior components 28
50 vented coupler of plurality of exterior components 28
52 handle of plurality of exterior components 28 for allowing brush 10 to be hand-held
58 threaded end cap of plurality of exterior components 28

Plurality of Interior Components 30

60 nylon mesh filter of plurality of interior components 30
62 electric digital fan assembly of plurality of interior components 30 for allowing the brush 10 to be self-cooling and vacuum operated
64 electronic button-operated speed control of plurality of interior components 30
66 button-operated power switch of plurality of interior components 30 for turning brush 10 on and off
68 battery interface of plurality of interior components 30 for holding battery 70 for powering brush 10
70 battery for powering brush 10 and for allowing brush 10 be cordless and rechargeable

DETAILED DESCRIPTION OF THE PREFERRED EMBODIMENT

Introductory

Referring now to the figures, in which like numerals indicate like parts, and particularly to FIG. 1, the brush of the embodiments of the present invention is shown generally at 10 for being hand-held 12, cordless 14, rechargeable 16, self-cooling 18, and vacuum operated 20 so as to loosen and collect dust 22 and other small particles 24 from a surface 26.

Overall Configuration of the Brush 10

The overall configuration of the brush 10 can best be seen in FIG. 4, and as such, will be discussed with reference thereto.

The brush 10 comprises a plurality of exterior components 28 and a plurality of interior components 30. The plurality of interior components 30 is contained within the plurality of exterior components 28, and therewith, are for being the hand-held 12, the cordless 14, the rechargeable 16, the self-cooling 18, and the vacuum operated 20, so as to loosen and collect the dust 22 and the other small particles 24 from the surface 26.

Specific Configuration of the Plurality of Exterior Components 28

Figure 2:
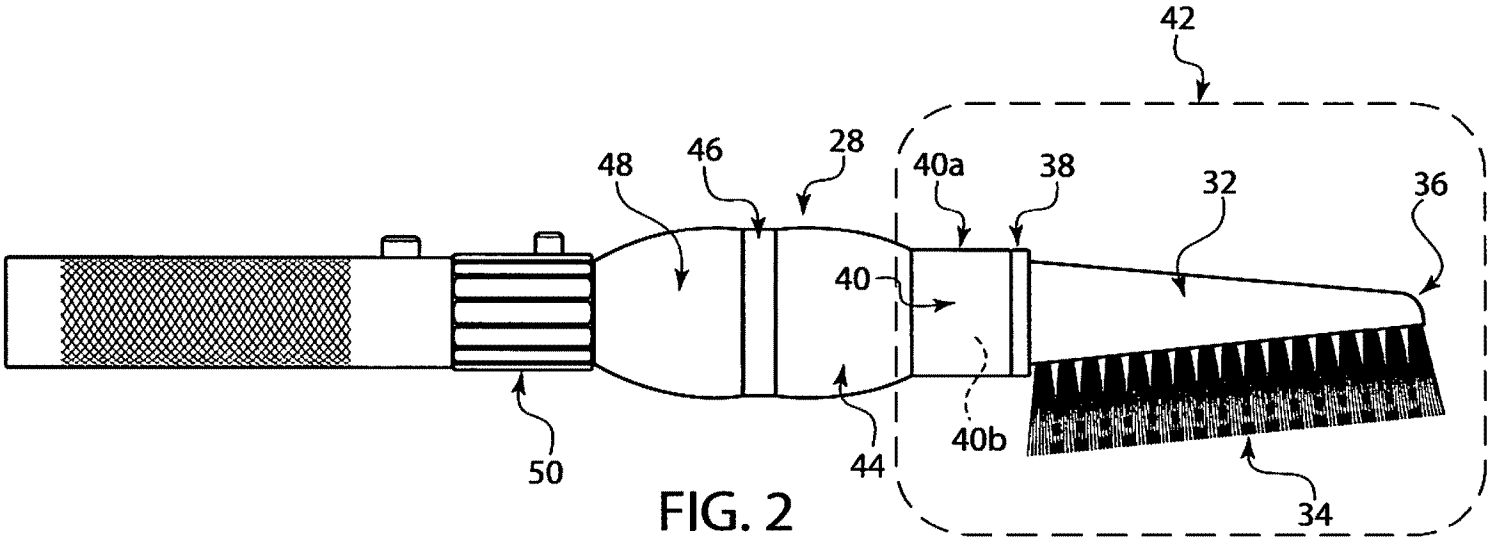
FIG. 2 is a side elevational view thereof per se.

The specific configuration of the plurality of exterior components 28 can best be seen in FIGS. 2 and 4, and as such, will be discussed with reference thereto.

The plurality of exterior components 28 comprise an vacuum intake brush body 32.

The plurality of exterior components 28 further comprise nylon fiber strands 34. The nylon fiber strands 34 of the plurality of exterior components 28 depend from the vacuum intake brush body 32, and together therewith, form a working end 36 of the brush 10.

The plurality of exterior components 28 further comprise a threaded brush body connector 38. The threaded brush body connector 38 is collinear with, and threadably attaches to, the vacuum intake brush body 32 of the plurality of exterior components 28.

The plurality of exterior components 28 further comprise an anterior coupler 40. The anterior coupler 40 of the plurality of exterior components 28 extends collinearly from, and threadably attaches to, the threaded brush body connector 38 of the plurality of exterior components 28, so as to allow an anterior portion 40*a* of the anterior coupler 40 of the plurality of exterior components 28 to replaceably slide into a remaining posterior portion 40*b* of the anterior coupler 40 of the plurality of exterior components 28, and in so doing, replaceably forms a front integral unit 42.

The plurality of exterior components 28 further comprise a filter housing 44. The filter housing 44 of the plurality of exterior components 28 extends collinearly from the anterior coupler 40 of the plurality of exterior components 28.

The plurality of exterior components 28 further comprise a posterior coupler 46. The posterior coupler 46 of the plurality of exterior components 28 extends collinearly from, and threadably attaches to, the filter housing 44 of the plurality of exterior components 28.

The plurality of exterior components 28 further comprise an electric fan housing 48. The electric fan housing 48 of the plurality of exterior components 28 extends collinearly from, and threadably attaches to, the posterior coupler 46 of the plurality of exterior components 28.

The plurality of exterior components 28 further comprise a vented coupler 50. The vented coupler 50 of the plurality of exterior components 28 extends collinearly from, and replaceably attaches to, the electric fan housing 48 of the plurality of exterior components 28.

The plurality of exterior components 28 further comprise a handle 52. The handle 52 of the plurality of exterior components 28 extends collinearly from the vented coupler 50 of the plurality of exterior components 28 and is for allowing the brush 10 to be hand-held.

The plurality of exterior components 28 further comprise a threaded end cap 58. The threaded end cap 58 of the plurality of exterior components 28 extends collinearly from, and threadably attaches to, the handle 52 of the plurality of exterior components 28.

Specific Configuration of the Plurality of Interior Components 30

Figure 3:
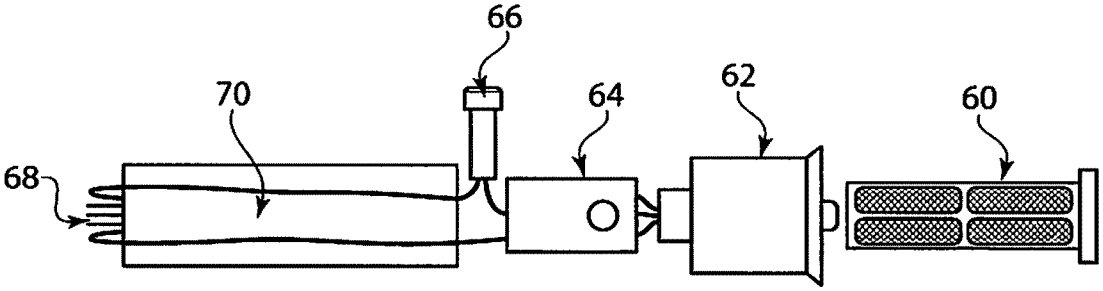
FIG. 3 is a diagrammatic elevational view of selected internal components per se and separated from the housing of the handheld cordless dust removal appliance.
Figure 4:
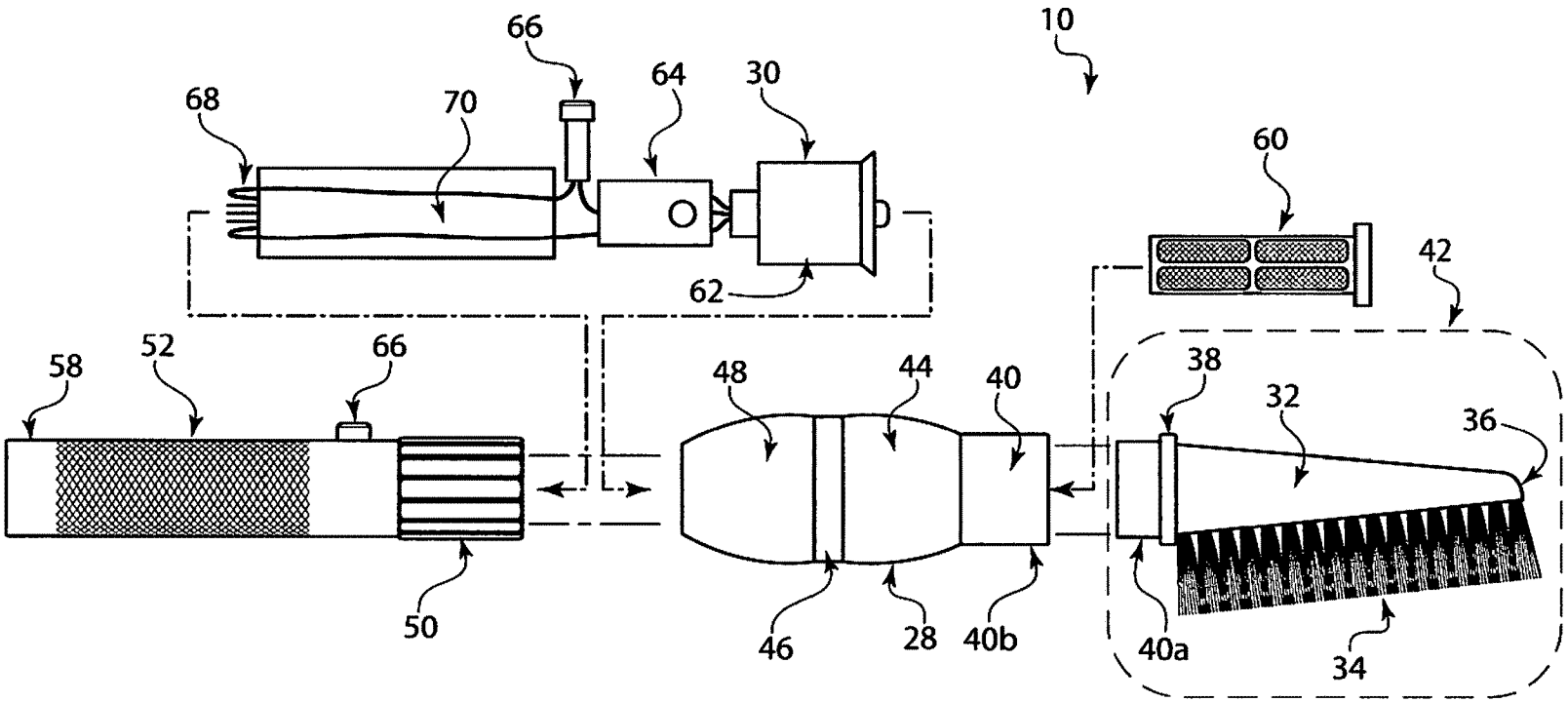
FIG. 4 is diagrammatic elevational view showing where the selected internal components are located in the handheld cordless dust removal appliance.

The specific configuration of the plurality of interior components 30 can best be seen in FIGS. 3 and 4.

The plurality of interior components 30 comprise a nylon mesh filter 60. The nylon mesh filter 60 of the plurality of interior components 30 is removably contained within the filter housing 44 of the plurality of exterior components 28.

The plurality of interior components 30 further comprise an electric digital fan assembly 62. The electric digital fan assembly 62 of the plurality of interior components 30 is contained within the electric fan housing 48 of the plurality of exterior components 28 and is for allowing the brush 10 to be self-cooling and vacuum operated.

The plurality of interior components 30 further comprise an electronic button-operated speed control 64. The electronic button-operated speed control 64 of the plurality of interior components 30 is contained within the vented coupler 50 of the plurality of exterior components 28, and is in electrical communication with, and controls the speed of, the electric digital fan assembly 62 of the plurality of interior components 30.

The plurality of interior components 30 further comprise a button-operated power switch 66. The button-operated power switch 66 of the plurality of interior components 30 is contained within the handle 52 of the plurality of exterior components 28, is in electrical communication with the electronic button-operated speed control 64 of the plurality of interior components 30, and is for turning the brush 10 on and off.

The plurality of interior components 30 further comprise a battery interface 68. The battery interface 68 of the plurality of interior components 30 is contained within the handle 52 of the plurality of exterior components 28, electrically communicates with both the button-operated power switch 66 of the plurality of interior components 30 and the electronic button-operated speed control 64 of the plurality of interior components 30, and is for holding a battery 70 for powering the brush 10 and for allowing the brush 10 to be cordless and rechargeable.

As shown in FIG. 4, the plurality of interior components 30 are accessible by separating the vented coupler 50 of the plurality of exterior components 28 from the electric fan housing 48 of the plurality of exterior components 28.

IMPRESSIONS

It will be understood that each of the elements described above, or two or more together, may also find a useful application in other types of constructions differing from the types described above.

While the invention has been illustrated and described as embodiments of a hand-held cordless dust removal appliance, accordingly it is not limited to the details shown, since it will be understood that various omissions, modifications, substitutions, and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that from the standpoint of prior art fairly constitute characteristics of the generic or specific aspects of the present invention.

The invention claimed is:

1. A brush for being hand-held, cordless, rechargeable, self-cooling, and vacuum operated, so as to loosen and collect dust and other small particles from a surface, comprising:

a) a plurality of exterior components; and b) a plurality of interior components;

wherein said plurality of interior components are contained within said plurality of exterior components, and therewith, are for being hand-held, cordless, rechargeable, self-cooling, and vacuum operated, so as to loosen and collect the dust and the other small particles from the surface;

wherein said plurality of exterior components comprise a vacuum intake brush body;

wherein said plurality of exterior components comprise a threaded brush body connector;

wherein said threaded brush body connector of said plurality of exterior components is collinear with said vacuum intake brush body of said plurality of exterior components;

wherein said threaded brush body connector of said plurality of exterior components threadably attaches to said vacuum intake brush body of said plurality of exterior components;

wherein said plurality of exterior components comprise an anterior coupler;

wherein said anterior coupler of said plurality of exterior components extends collinearly from said threaded brush body connector of said plurality of exterior components;

wherein said anterior coupler of said plurality of exterior components threadably attaches to said threaded brush body connector of said plurality of exterior components;

wherein said plurality of exterior components comprise a filter housing;

wherein said plurality of exterior components comprise a posterior coupler;

wherein said posterior coupler of said plurality of exterior components extends collinearly from said filter housing of said plurality of exterior components;

wherein said posterior coupler of said plurality of exterior components threadably attaches to said filter housing of said plurality of exterior components;

wherein said plurality of exterior components comprise an electric fan housing;

wherein said electric fan housing of said plurality of exterior components extends collinearly from said posterior coupler of said plurality of exterior components;

wherein said electric fan housing of said plurality of exterior components threadably attaches to said posterior coupler of said plurality of exterior components;

wherein said plurality of exterior components comprise a vented coupler;

wherein said vented coupler of said plurality of exterior components extends collinearly from said electric fan housing of said plurality of exterior components;

wherein said plurality of exterior components comprise a handle for allowing said brush to be hand-held;

wherein said handle of said plurality of exterior components extends collinearly from said vented coupler of said plurality of exterior components;

wherein said plurality of exterior components comprise a threaded end cap;

wherein said threaded end cap of said plurality of exterior components extends collinearly from said handle of said plurality of exterior components; and wherein said threaded end cap of said plurality of exterior components threadably attaches to said handle of said plurality of exterior components for allowing access to a battery in said handle of said plurality of exterior components.

2. The brush of claim 1, wherein said plurality of exterior components comprise nylon fiber strands.

3. The brush of claim 2, wherein said nylon fiber strands of said plurality of exterior components depend from said vacuum intake brush body of said plurality of exterior components.

4. The brush of claim 2, wherein said vacuum intake brush body of said plurality of exterior components together with said nylon fiber strands of said plurality of exterior components form a working end of said brush.

5. The brush of claim 1, wherein an anterior portion of said anterior coupler of said plurality of exterior components slides into a remaining posterior portion of said anterior coupler of said plurality of exterior components, and in doing so, replaceably forms a front integral unit.

6. The brush of claim 1, wherein said filter housing of said plurality of exterior components extends collinearly from said anterior coupler of said plurality of exterior components.

7. The brush of claim 1, wherein said vented coupler of said plurality of exterior components replaceably attaches to said electric fan housing of said plurality of exterior components.

8. The brush of claim 1, wherein said plurality of interior components comprise a nylon mesh filter.

9. The brush of claim 8, wherein said nylon mesh filter of said plurality of interior components is removably contained within said filter housing of said plurality of exterior components.

10. The brush of claim 1, wherein said plurality of interior components comprise an electric digital fan assembly.

11. The brush of claim 10, wherein said electric digital fan assembly of said plurality of interior components is contained within said electric fan housing of said plurality of exterior components; and wherein said electric digital fan assembly of said plurality of interior components is for allowing said brush to be self-cooling and vacuum operated.

12. The brush of claim 10, wherein said plurality of interior components comprise an electronic button-operated speed control.

13. The brush of claim 12, wherein said electronic button-operated speed control of said plurality of interior components is contained within said vented coupler of said plurality of exterior components.

14. The brush of claim 12, wherein said electronic button-operated speed control of said plurality of interior components is in electrical communication with said electric digital fan assembly of said plurality of interior components.

15. The brush of claim 12, wherein said electronic button-operated speed control of said plurality of interior components controls speed of said electric digital fan assembly of said plurality of interior components.

16. The brush of claim 12, wherein said plurality of interior components comprise a button-operated power switch; and wherein said button-operated power switch of said plurality of interior components is for turning said brush on and off.

17. The brush of claim 16, wherein said button-operated power switch of said plurality of interior components is contained within said handle of said plurality of exterior components.

18. The brush of claim 16, wherein said button-operated power switch of said plurality of interior components is in electrical communication with said electronic button-operated speed control of said plurality of interior components.

19. The brush of claim 16, wherein said plurality of interior components comprise a battery interface; and wherein said battery interface of said plurality of interior components is for holding a battery for powering said brush and for allowing the brush 10 to be cordless and rechargeable.

20. The brush of claim 19, wherein said battery interface of said plurality of interior components is contained within said handle of said plurality of exterior components.

21. The brush of claim 19, wherein said battery interface of said plurality of interior components electrically communicates with said button-operated power switch of said plurality of interior components.

22. The brush of claim 19, wherein said battery interface of said plurality of interior components electrically communicates with said electronic button-operated speed control of said plurality of interior components.

23. The brush of claim 1, wherein said plurality of interior components are accessible by separating said vented coupler of said plurality of exterior components from said electric fan housing of said plurality of exterior components.

* * * * *